US006986549B2

(12) United States Patent
Kniese

(10) Patent No.: US 6,986,549 B2
(45) Date of Patent: Jan. 17, 2006

(54) SEATING ELEMENT

(76) Inventor: Leif Kniese, Teutonenstr. 27, 14129 Berlin (DE)

( * ) Notice: Subject to any disclaimer, the term of this patent is extended or adjusted under 35 U.S.C. 154(b) by 31 days.

(21) Appl. No.: 10/393,512

(22) Filed: Mar. 19, 2003

(65) Prior Publication Data

US 2004/0183348 A1 Sep. 23, 2004

(51) Int. Cl.
*A47C 7/46* (2006.01)

(52) U.S. Cl. ..... 297/284.1; 297/452.18

(58) Field of Classification Search ..... 297/284.1, 297/284.2, 284.3, 284.4, 452.18, 452.29, 297/452.3, 452.31, 452.19, 452.15
See application file for complete search history.

(56) References Cited

U.S. PATENT DOCUMENTS

| | | | | |
|---|---|---|---|---|
| 3,877,750 | A * | 4/1975 | Scholpp | 297/284.3 |
| 5,240,308 | A * | 8/1993 | Goldstein et al. | 297/284.3 |
| 5,328,245 | A * | 7/1994 | Marks et al. | 297/284.3 |
| 5,518,294 | A * | 5/1996 | Ligon et al. | 297/284.4 |
| 5,954,399 | A * | 9/1999 | Hong | 297/284.4 |
| 6,609,754 | B2 * | 8/2003 | Rajasingham | 297/284.3 |
| 6,820,933 | B2 * | 11/2004 | Fereira Da Silva | 297/284.1 |

FOREIGN PATENT DOCUMENTS

| | | |
|---|---|---|
| AU | 65 633/80 | 1/1983 |
| EP | 0860355 | 8/1998 |
| FR | 2715124 | 7/1995 |
| LU | 88528 | 3/1996 |

OTHER PUBLICATIONS

Beitz, W., et al., "*Dubbel: Taschenbuch für den Machinenbau* (17*Auflage*)," (1990) Springer-Verlag, Berlin, DE XP002203654 (Seite C8, Splate 2, Absatz 2.4.1—Seite C11, Spalte 2, Absatz 2.4.2; Tabelle 1.

* cited by examiner

*Primary Examiner*—Peter R. Brown
(74) *Attorney, Agent, or Firm*—Boyle Fredrickson Newholm Stein & Gratz S.C.

(57) ABSTRACT

A seating element is provided, comprising a skeleton having a skin and a plurality of ribs pivotably connected with said skin. The skin forms a substantially flexible support area, which is adapted to support a seating force exerted by a body, e.g. a human sitting or lying on the seating element. The skeleton is configured in such a way that it cooperates to at least partially deform the support area in a direction opposite to the direction of the seating force as a result of the seating force. As a result a comfortable and ergonomic seating posture is obtained. The seating element with skeleton automatically counteracts all movements of the body, thus supporting the body in an optimum way.

27 Claims, 7 Drawing Sheets

SEATING ELEMENT

FIELD OF THE INVENTION

The invention relates to a seating element, such as a seating element used in chairs, stools, sofas, couches, beds, stretchers and seats. In particular, the invention relates to a seating element that uses a skeleton comprising a skin and ribs and adjusts its shape in response to a body resting on said seating element

BACKGROUND OF THE INVENTION

Seating elements in form of a seat and a backrest, or of a combination of a seat and a backrest, come in a variety of forms, shapes, and structures. It is common that seating elements are adapted to fit closely those parts of the human body that are resting on the seat. For example, the backrest is formed to accommodate the human back by being bent in the shape of the human spine.

To improve seating comfort and to improve ergonomics, modern seats and chairs feature shape adjustment means, which allow adjusting the shape of the seating elements to the needs of the user. For example, the inclination and curvature of the backrest may be changed, or a lumbar support may be personal adjusted, in order to most ergonomically support the user that is in contact with the seating element. The shape adjustment means known from the prior art, however, require actuation by hand. Once the shape has been set by the user, it stays more or less constant until the shape adjustment means is again actuated by the user. Thus, it is usually a time-consuming process until a user has found a comfortable position, as such a position has to be found by trial and error.

In order to overcome this problem, a different approach is taken in DE 199 16 411 A1 and also in EP 002 50 109 A1. In both documents, a skeleton or framing is described which is capable of reacting to a load applied on said skeleton by actively and automatically deforming against the action of said load. Although use of this skeleton is primarily intended for aerodynamics, it is also described that the skeleton may also be used for seating elements.

It should be noted that structures, which look similar to the skeleton of DE 199 16 411 A1 and EP 002 50 109 A1 are known from aerodynamics. The only purpose of these aerodynamic structures, however, is to provide a body of which the shape can be changed manually using actuators. For example, in EP 0 860 355 A1, a landing flap section is described. Using mechanical actuators, the camber of the section may be changed. In FR 2 715 124 A1 and LU 88 528 A1, sailing structures are shown, of which the camber may be adjusted by rotation of the leading edge.

In contrast to the self-adjusting structure described in DE 199 16 411 A1 and EP 002 50 109, however, the structures of EP 0 860 355 A1, FR 2 715 124 A1, and LU 88 528 A1 require actuators to effect a shape change.

Starting from DE 199 16 411 A1 and EP 002 50 109, it is one object of the invention to adapt the structure described in these documents for further improving the ergonomics of seating elements.

Moreover, it is an object of the invention to provide a seating element that is easy to manufacture.

Finally, it is an object of the invention to provide a seating element that is easily adjusted to various human body shapes.

SUMMARY OF THE INVENTION

In accordance with the invention, a seating element is provided, which comprises a skeleton having a skin and a plurality of ribs pivotably connected with said skin. The skin forms a substantially flexible support area, which is adapted to support a seating force exerted by a body, e.g. a human sitting or lying on the seating element. The support area is that part of the skin on which the body rests if the seating element is put to use.

The skeleton is configured in such a way that it cooperates to at least partially deform the support area in a direction opposite to the direction of the seating force as a result of the seating force. As a result a comfortable and ergonomic seating posture is obtained. The seating element with the skeleton automatically counteracts all movements of the body and all changes in the seating force by an opposite deformation, thus supporting the body in an optimum way.

The term "seating element" in this context is meant to comprise any element that is adapted to support a human body, such as the seat and/or backrest of a chair, a sofa, a stool, a couch, a stretcher, or a bed. As such, the seating element according to the invention is particularly adapted for use in furniture for home or professional use.

The term "tension element" is meant to comprise any structure that primarily transmits tensile forces and only to a substantially much lesser degree, or not at all, pressure or shearing forces. Such a tension element especially includes, among others, ropes, chains, wires, cords, strips, webbings, and belts.

According to one advantageous embodiment seating element may be configured as a unitary piece, in which the ribs and the skin are integrally formed, e.g. by molding. This configuration provides a seating element that is easily and inexpensively to manufacture. In particular, such a unitary seating element may form both the seat and the back of a chair.

Another feature of the invention is concerned with a shape adjustment means, which introduces a biasing force into the skeleton. The skeleton reacts to the biasing force by changing its shape. Additionally, the biasing force leads to a local change in the elasticity of the skeleton, as regions of the skeleton that have been deformed under the action of the biasing force, will be stiffer than regions, which have been unaffected by the biasing force. Thus, the shape adjustment means may be used to adjust the shape and elasticity characteristics of the skeleton to various needs, such as accommodating humans of different size and weight.

In a further improvement, the shape adjustment means may make use of the tension element for transmitting the biasing force into the skeleton. For example, the tension element may be guided past and be deflected by the ribs. Due to the deflection, the tension element will introduce the biasing force into the ribs. Moreover, the tension element may also be connected with the skin and introduce the biasing force into the skin. Preferably, the biasing force is introduced into the skeleton in the area, where the ribs are connected with the skin. Thus, the biasing force will affect both the skin and the ribs.

For the shape of the skeleton to simulate the shape of those human body parts that come into contact with the seating element, such as the spine and the buttocks, the tension element may be guided along a zigzagging way past a plurality of deflection points. This will lead to an S-shaped change in the contour of the skeleton if the tension element is loaded with a tensile force. To reduce friction, pulleys may be used at the points, where the tension element is deflected.

In order to be able to fine-adjust the change of shape of the skeleton, a plurality of shape adjustment means may be provided, each one of them having a restricted region of influence, where the biasing force is introduced into the skeleton the shape of the skeleton is only locally affected.

The shape adjustment means may also comprise other elements, such as fluid-filled pads. These pads may be inflatable to adjust their resiliency. Other pads may be filled with gel to increase comfort. The pads may extend through the support area to form a cushion-like support area.

The seating element may be covered with leather or textile materials to further improve comfort.

According to another feature of the invention, the seating element may comprise a biasing element oriented substantially along the diagonal of a section defined by two, not necessarily adjacent, ribs and the skin. This section may have a substantially rectangular cross-section.

The biasing element introduces a biasing force along the diagonal into the skeleton. This leads to an improved load distribution of the seating force within the skeleton and to an improved stability of the skeleton. The biasing element may be a tension element transmitting only tensile forces, or a pressure element transmitting pressure, and if necessary, tensile forces.

BRIEF DESCRIPTION OF THE DRAWINGS

The features that are considered characteristic of the invention are set forth with particularity in the appended claims.

The invention itself, however, both as to its design and its method of operation together with its objects and advantages will be best understood from the following description of illustrated embodiments when read in conjunction with the accompanying drawings wherein.

DETAILED DESCRIPTION OF THE PREFERRED EMBODIMENTS

In the following description, identical reference numbers are used throughout the various embodiments and drawings to indicate elements or features having identical function or design.

Figure 1:
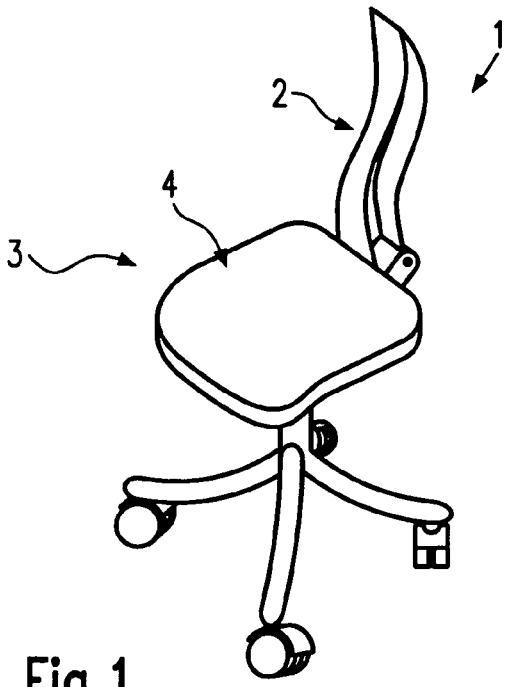
FIG. 1 is a schematic representation of a first embodiment of a seating element according to the invention in a perspective view.

FIG. 1 shows a first embodiment of a seating element 1 according to the invention. The seating element 1 has a support area formed as a backrest 2 of a chair 3 or as a seat 4. The seating element 1, however, may not only be used on a chair 3 but also on any other structure designed to support the human body, such as a bed, a stretcher, a couch, or a stool. The structure, which is equipped with seating element 1 may be of conventional design, as shown in FIG. 1 where a common office chair is shown for illustrative purposes.

Figure 2:
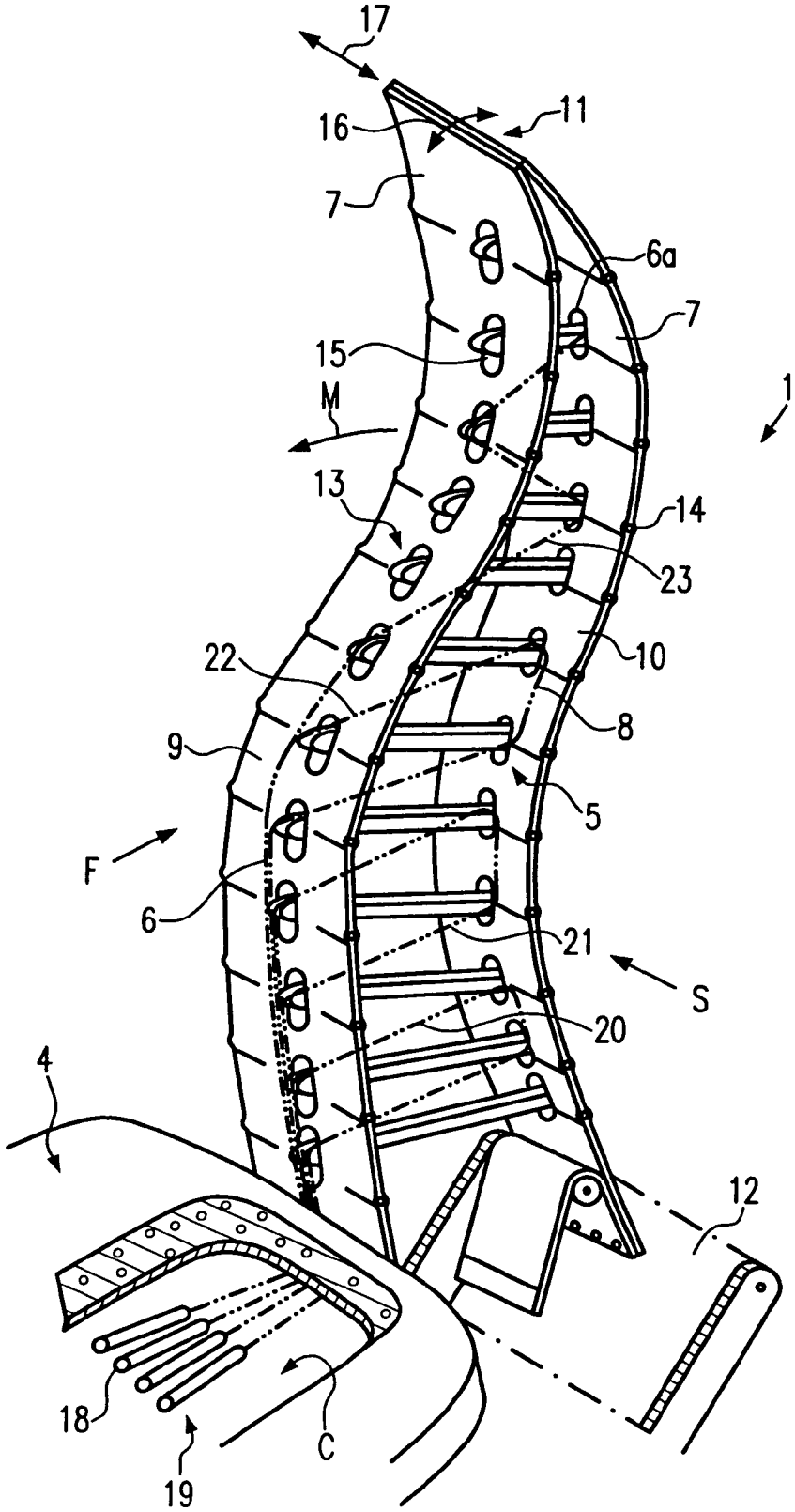
FIG. 2 is a detailed representation of a backrest of the seating element of FIG. 1 in a schematic and perspective view.

The design of a first embodiment of seating element 1 is shown in more detail in FIG. 2. Seating element 1 comprises a skeleton 5 having a plurality of ribs 6 pivotably attached to an at least sectionwise flexible skin 7 and having at least one tension element 8 extending between at least one of ribs 6 and skin 7. Skin 7 may be covered with a soft, textile material or fabric to increase comfort. Tension element 8 may be a rope, a cord, a webbing, or a belt.

In the embodiment of FIG. 2, skin 7 is shown to actually comprise of two separate parts 9 and 10 in a wedge-like configuration. At a distal end 11 of skin 7, parts 9 and 10 are connected with each other. Distal end 11 is situated at the upper end of the backrest. Distal end 11 may be pointed, as shown in FIG. 2, or rounded. Alternatively, parts 9 and 10 may be bodily united to form an integral one-piece skin 7.

At their proximal ends, parts 9 and 10 of skin 7 are connected with a supporting structure 12 of chair 3. Supporting structure 12 may comprise legs, a base, roller and so on.

Ribs 6 are arranged at predetermined intervals on skin 7 and are bridging the interior space of skeleton 7 formed between parts 9 and 10 of skin 7. At their respective ends 13, ribs 6 are held by hinge-like joints comprising an axle 14 in skin 7. Axle 14 constitutes the pivot axis of ribs 6 with respect to skin 7. Ribs 6 extend through an opening 15 in skin 7 which allows a pivot movement of ribs 6 with respect to skin 7. Further, opening 15 guides ribs 6 in a direction substantially perpendicular to the pivot plane, and locks ribs 6 in place. At the positions of axles 14, thickness of skin 7 may be reduced, which leads to an increased flexibility in the region. The regions of skin 7 located between axles 14 may be stiffer such that the skeleton 5 actually has a flexibility closely resembling the flexibility of a human spine.

In the embodiment of FIG. 2, ribs 6 are approximately evenly spaced in the vertical direction along backrest 2, and approximately parallel to each other. In other configurations, however, ribs 6 may be unevenly spaced and also point in various directions, depending on their position on skin 7. By varying the position and orientation of ribs 6, skeleton 5 may be adapted to the expected mechanical leading and the desired flexibility. For example, ribs 6 may be orientated along the direction of pressure forces.

Parts 9 and 10 of skin 7 are made from a flexible elastomeric or thermoplastic material, or of wood, plywood or metal and may flex in the direction of arrow 16, i.e. substantially in the direction of ribs 7. In the direction of arrow 17, however, skin 7 is preferably rigid to provide sufficient lateral support to a user. The shape of ribs 6 may not be restricted to the rod-like configuration shown in FIG. 2 as, also, more planar configurations such as plates are possible.

In an alternative embodiment, Part 10 of skin 7 may be formed as an elastically biased brace, which, via distal end 11, spreads part 9 of skin 7. Thus, only a tensile stress is transferred to part 9 and to ribs 6. Accordingly ribs 6 may be formed as tension elements.

In FIG. 2, an idle position of seating element 1 is shown. In the idle or neutral position, no external forces from e.g. human bodies using chair 3 are acting on seating element 1 and seating element 1 may assume a position resembling the S-bent shape of a human spinal chord. The idle position is adjusted by the at least one tension element 8. Tension element 8 is connected at one of its ends with skin 7 and one of ribs 6 and alternatingly wound around the ends of other ribs 6 running substantially diagonally through a section of skeleton 5 made up by two ribs 6 and parts 9 and 10 of skin 7. Ribs 6 of a section may be adjacent; however, a section may also be made up by two non-adjacent ribs, with at least one interposed rib. Thus, tension element 8 assumes a zig-zag or staggering shape along skeleton 5 when seen in a side view along direction S. The other end 18 of tension element 8 ends in a shape adjustment means 19, where a tensioning or pulling force may be introduced into tension element 8, e.g. by a winding apparatus comprising a pulley around which tension element 8 is wound.

Figure 4:
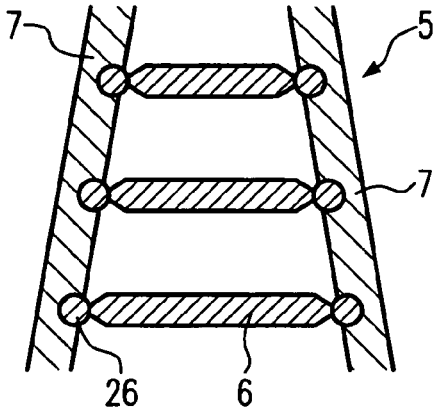
FIG. 4 shows an alternative embodiment of the junction between a rib and a skin of a seating element according to the invention.

It should be noted that part of the seat 4 has been cut away in region C in FIG. 4 in order to permit view of shape adjustment means 19 and ends 18.

By exerting a pulling force on tension element 8, a biasing force is introduced into those of ribs 6, which deflect tension element 8, and into flexible skin 7, both of which react to deform skeleton 5. In the idle position, there is a balance between the biasing force of tension element 8 and the elastic restoring force of skin 7. Those parts of skeleton 5, which are deformed under the biasing force, will exhibit a higher degree of stiffness and will be less flexible than the undeformed parts. Thus, the resistant properties of skeleton 5 may be adjusted.

In order to fine-tune the idle position, more than one tension element may be provided. For example, as shown in FIG. 2 a total of four tension elements 8, 20, 21, 22, or any other number of tension elements, may be present. For ease of discrimination, the tension elements 8, 20, 21, 22 are shown in different line styles. Each tension element 8, 20, 21, 22 ends in a different area of skin 7 and is zigzaggingly wound in a different way along skeleton 5. Thus, each tension distributes its pulling force differently across skeleton 5 and affects the shape of skeleton 5 in different areas.

For example, tension element 23, in FIG. 2 shown with three dots, ends on the next-to-last rib 6*a* and is wound only over the ribs 6 in the upper quarter of skeleton 5. Therefore, actuation of tension element 23 will mostly affect the shape in the upper quarter of skeleton 5, e.g. by bending end 11 towards seat 4, permitting a locally restricted adjustment.

Likewise, tension element 20 is only passing the ribs in the lower quarter of skeleton 5. Thus, actuation of tension element 20 will primarily affect the shape of skeleton 5 in the lower quarter, i.e. be locally limited to the area close to the seating plane as defined by seat 4.

The tension elements may also be used in a fixed manner, without shape adjustment means. In this configuration, the tension element is biased with a predetermined pulling force when the seating element 1 is being assembled. Then, both ends of the tension element are fixed in order to permanently exert the pre-installed pulling force on the skeleton. Tension element 8 in this configuration serves as a biasing element, affecting the distribution of seating force F within skeleton 5. In the same manner, a biased pressure element may be used instead of tension element 8. Such a pressure element may be made for example from a compressed rubber material that is put between two ribs 6. In the case of a pressure element as biasing element, the biasing force will primarily be a pressure force.

If a person sits on chair 3, a seating force F is exerted by this person on support area 3. Due to the elasticity of skin 7, skin 7 will be deformed by the force F at least in the support area. The force F will be then transmitted throughout the skeleton 5 by ribs 6, skin 7, and tension elements 8. Skeleton 5 will react to the seating force F by movement of the distal end 11 against the direction of force F, i.e. by a counter-acting movement M. This movement M will lead to an ergonomic, large-surface support of the body parts, which come into contact with seating element 1. Moreover, whenever the body of a seated person changes the direction or strength of force F, e.g. by stuffing the body, this change will be immediately countered by a movement M of support area 3. This leads to a very comfortable and highly stable seating experience, as all movements of the seated body are actively and automatically countered by skeleton 5.

Figure 3:
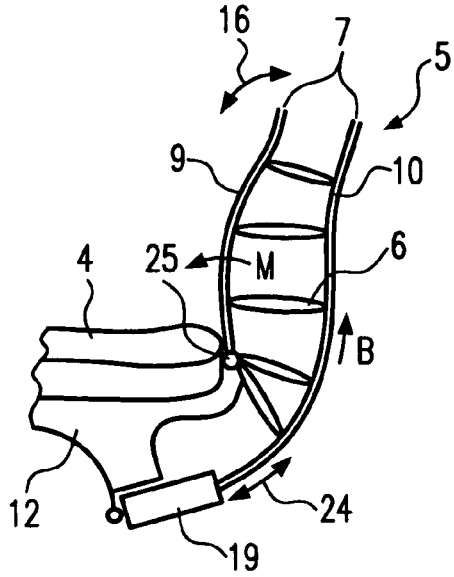
FIG. 3 is a schematic cross-sectional view of an alternative embodiment of a shape adjustment means for the seating element of FIGS. 1 and 2.

FIG. 3 shows an alternative embodiment of shape adjustment means 19 at the proximal end of skeleton 5, which may be used in combination with or instead of shape adjustment means 19 of FIG. 2. Shape adjustment means 19 of FIG. 3 directly acts on skin 7 by pulling in or pushing out part 10 of skin 7 in the direction of arrow 24.

Movement of skin 7 in the direction of arrow 24 will lead to a movement of the whole skeleton 5 in the direction of arrow 16: If skin 7 is pushed out of the shape adjustment, end 11 of skeleton 5 (cf. FIG. 2) will bend towards seat 4 and part 9 will bulge out. Hinge 25 on the proximal end of skeleton 5 is used to support biasing force B and to allow pivot movement of skeleton 5.

Next, various configurations for the connection of ribs 6 with skin 7 are described. These configurations may be alternatively used, or they may be used in combination.

FIG. 4 shows a detail of a skeleton 5 comprising skin 7 connected by ribs 6. Ribs 6 according to this embodiment are integrally formed at each end with an axle-like or arbor-like member 26 having a substantially circular cross-section. Members 26 are lockingly and pivotably received in a recess in skin 7 of corresponding shape. Ribs 7 may be molded or injection molded plastic elements and easily installed by being clipped into place. Alternatively, wooden or metal ribs may be used. Naturally, the opposite design may also be realized, where the axle-like members are formed on the inner parts of skin 7 and said recess is formed on ribs 6.

Figure 5:
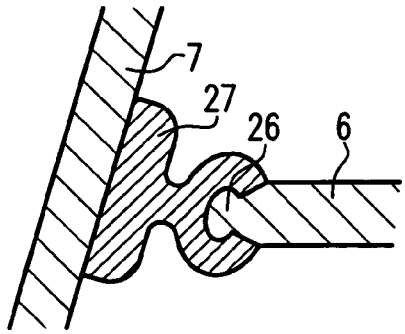
FIG. 5 shows another alternative embodiment of the junction between a rib and a skin of a seating element according to the invention.

FIG. 5 shows a detail of another embodiment of a connection between ribs 6 and skin 7: Between rib 6 and skin 7, there is arranged a connecting element 27 of synthetic material. Axle-like member 26 is pivotably received in a recess of element 27. Element 27 itself is arranged on skin 7 by glueing, ultrasound welding, or molding. Preferably, element 27 is made of an elastic material so that it deforms if skeleton 5 is loaded with seating force F. Thus, skeleton 7 becomes more responsive to seating force F. Element 27 may also comprise zones of varying degrees of elasticity. For example, the part of element 27 surround the recess may be harder so that member 26 is held strongly even if element 27 is deformed.

Figure 6:
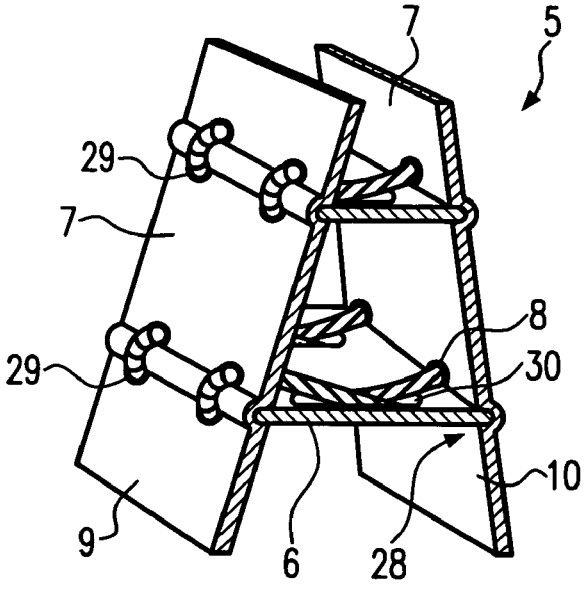
FIG. 6 shows yet another alternative embodiment of the junction between a rib and a skin of a seating element according to the invention.

In FIG. 6 an embodiment of skeleton 5 is shown, where recesses, e.g. grooves 28, are formed in skin 7. Ribs 6 are formed as plate-like structures, the ends of which are received in grooves 28, respectively. Skeleton 5 is biased by the action of rope-like or belt-like tension elements 8 made of elastic material and girdling ribs 6. Tension elements 8 extend through holes 29 in skin 7, holes 29 being arranged in pairs above and below grooves 28, respectively. Ribs 6 are held in place by tension elements 8 that are elastically stretched and therefore forcing parts 9 and 10 of skin 7 towards each other, thereby pressing ribs 6 firmly into recesses 28. To increase stability, tension elements 8 may be arranged in a crossed, X-shaped configuration as shown in FIG. 6. In this configuration, ribs 6 may be provided with holes 30 through which the crossing part of tension element 8 is guided.

Figure 7:
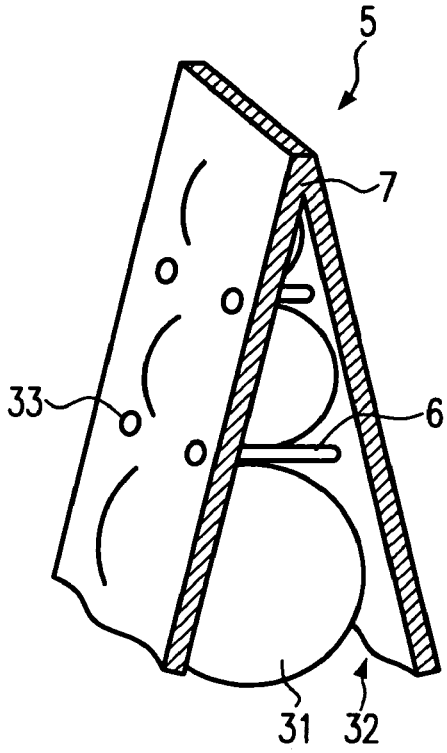
FIG. 7 shows an alternative embodiment of a skeleton of a seating element according to the invention, comprising a skin, ribs and fluid-filled elements.

In the embodiment of FIG. 7, skin 7 of skeleton 5 is elastically spread by elastic elements, such as fluid-filled containers or balloons 31 having a flexible envelope. The fluid in containers 31 is put under pressure so that an elastic biasing force is exerted on skin 7, which is held together against this biasing force by retention means 33, e.g. in the form of heads against which skin 7 is pressed. In this configuration, only tensile forces react on ribs 6, which accordingly may be configured as tension elements.

Figure 8:
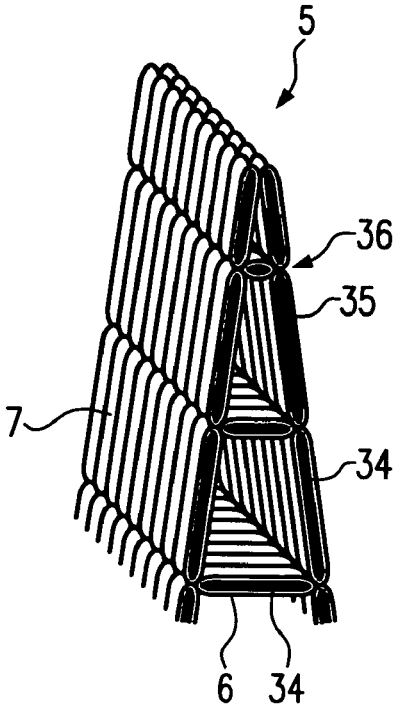
FIG. 8 shows another alternative embodiment of a skeleton of a seating element according to the invention, comprising a skin and ribs embedded in a mesh.

FIG. 8 shows a mesh- or web-like configuration of skeleton 5. Skin 7 and ribs 6 comprise stiffening elements 34 which are embedded, for example worked in, in a substantially textile material or a fabric 35 having high tensile strength. The flexibility of skin 7 and the movability of ribs 6 relative to skin 7 results from the limited movement in the areas 36, where the stiffening elements 33 are connected to each other by mesh 35. Some of the stiffening elements 35, e.g. the elements worked in in skin 7, may be more flexible than others, e.g. the bracing elements in ribs 6, to provide areas with different degrees of flexibility.

Figures 9, 10:
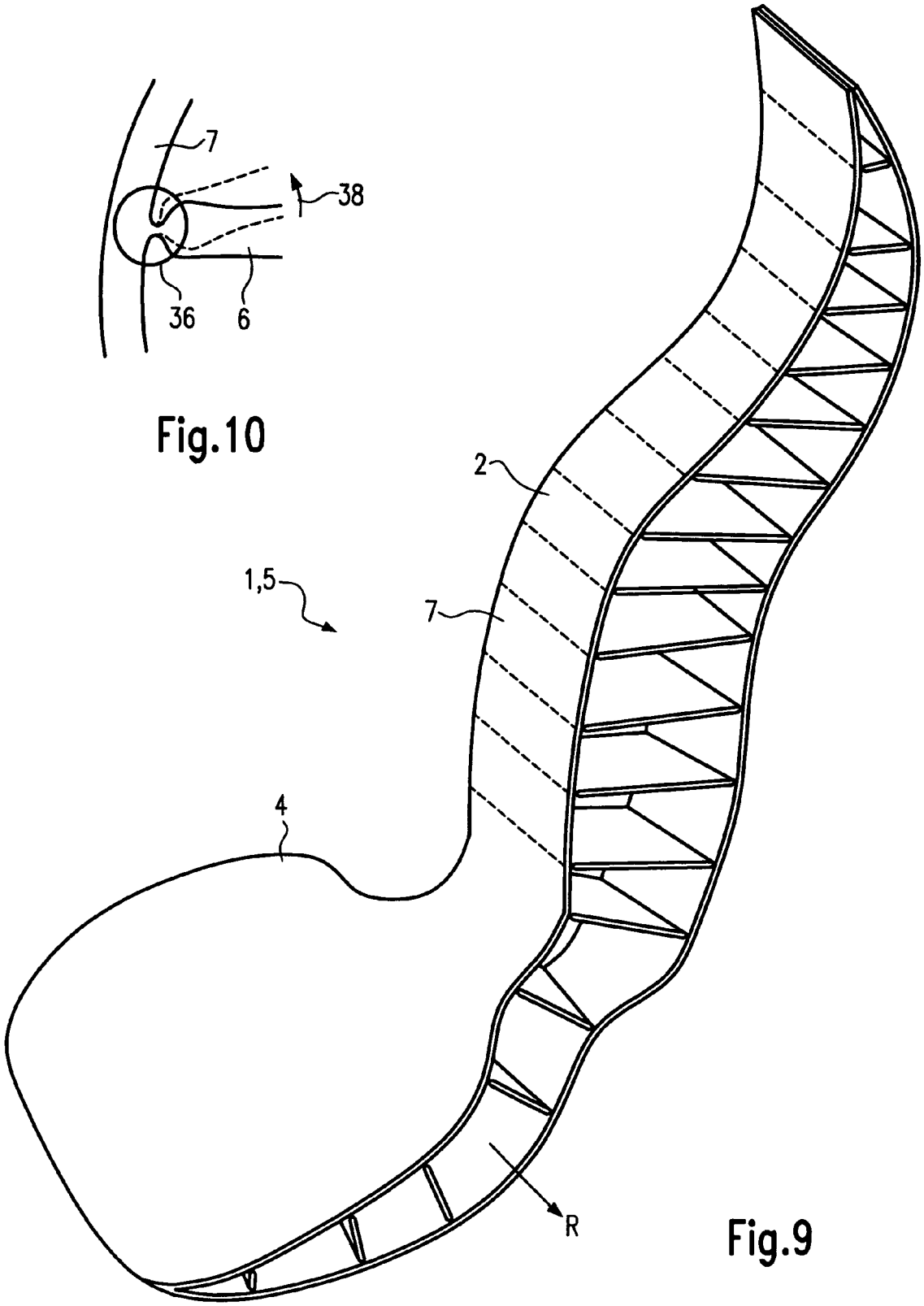
FIG. 9 shows a schematic representation of a second embodiment of a seating element according to the invention.
FIG. 10 shows a detail of the embodiment of FIG. 9.

FIG. 9 shows a schematic representation of a second embodiment of a seating element 1 according to the invention. In this configuration, seating element 1 is configured as an integrally molded chair 3, substantially formed as a single piece forming both seat 4 and back 2. Ribs 6 are molded in one process with skin 7 from a plastic material. The idle position as shown in FIG. 10 is obtained by careful design of the mold form. The position and orientation of ribs 6 is chosen such that, using standard measures of human shape and weight, skeleton 5 reacts to seating forces by moving parts against the seating force only in locations which are ergonomically advantageous. Various degrees of elasticity of skin 7 and ribs 6 are obtained by varying the material thickness throughout the seating element 1. For example, stiff areas may have higher material thickness.

In a modification of the embodiment of FIG. 9 only seat 4 or only back 2 may be molded as a single piece. The mold, or one half of the mold may be removed in direction R after hardening of the material of seating element 1. For this, all ribs formed by a mold are aligned in direction R, in which this mold is removed.

Although not shown, the skeleton chair of FIG. 9 may also have shape adjustment means to adjust its idle position.

FIG. 10 helps to explain how a pivotable attachment of ribs 6 to skin 7 may be realized in the one-piece molded chair of FIG. 9: In the connecting area 36, the thickness of ribs 6 is sharply reduced, which results in a highly flexible connection between rib 6 and skin 7. As rib 6 is connected to skin 7 substantially along a line, movement between rib 6 and skin 7 is restricted to pivotable movement, as indicated by arrow 38.

Figure 11:
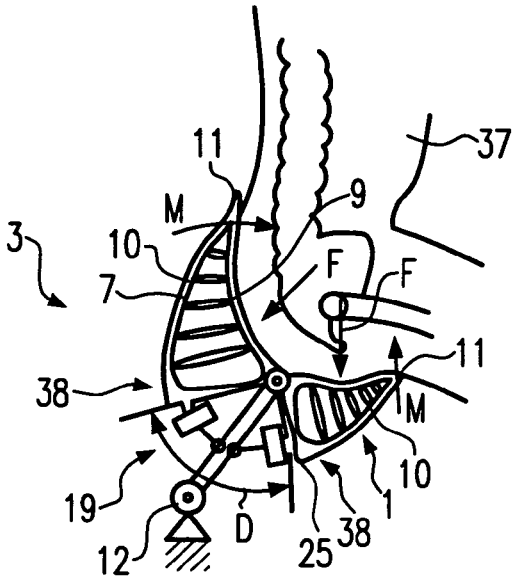
FIG. 11 shows a schematic representation of a third embodiment of a seating element according to the invention.

FIG. 11 shows a schematic representation of a stool 3 comprising two seating elements 1, which together form seat 4. Seating elements 1 are connected by hinge 25 on part 9 of skin 7 to seat support structure 12. A person 37 using stool 3 exerts seating force F on seating elements 1, which automatically react to seating force F by movement M of their ends 11. Movement M will lead to an improved ergonomic support of person 37.

As in the other embodiments, shape adjustment means 19 is used to bias seating elements 1 and to control movement M in response to seating force F. For this, shape adjustment means 19 controls the distance D between the free proximal ends 38 of seating elements 1. If the distance D is increased, distal ends 11 will tend to move inwards about hinge 25 as pivot point in the direction indicated by the arrows M. This will increase the supporting effect of seating element 1.

Figure 12:
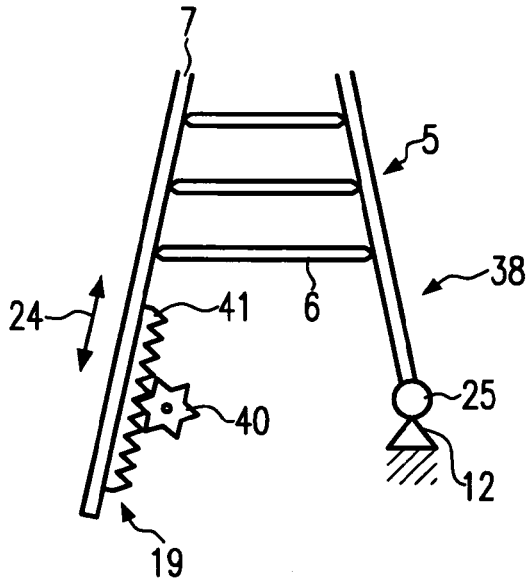
FIG. 12 shows a schematic representation of another embodiment of a shape adjustment means.

In FIG. 12, another embodiment of a shape adjustment means 19 is shown that may be used to adjust skeleton 5. Shape adjustment means 19 is provided with a first hinge point 25 at the proximal end of skeleton 5. Hinge 25 is connected to seat support structure 12, only represented schematically, and further connected elastically to shape adjustment means 19 via skin 7 and/or ribs 6.

Shape adjustment means 19 comprises a shifting mechanism comprising for example a gear wheel 40 meshing with a rack 41. Turning gear wheel 40 will result in a movement of skin 7 along arrow 24. A locking mechanism, not shown, may be provided to arrest wheel 40 and to fix the relative position of gear wheel 40 and rack 41.

Figure 13:
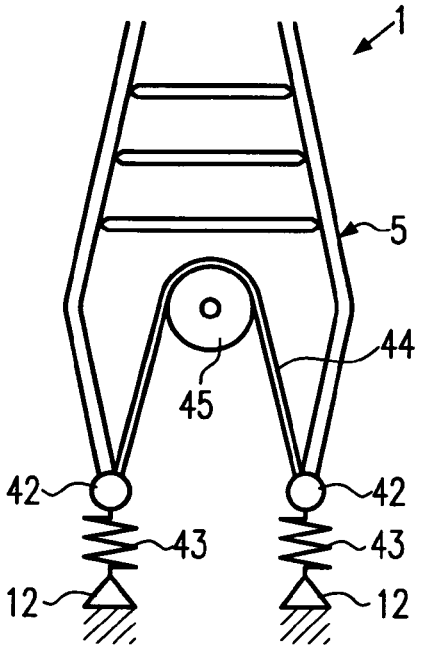
FIG. 13 shows a schematic representation of a shape adjustment means for a seating element according to the invention, said shape adjustment means being in a first position.
Figure 14:
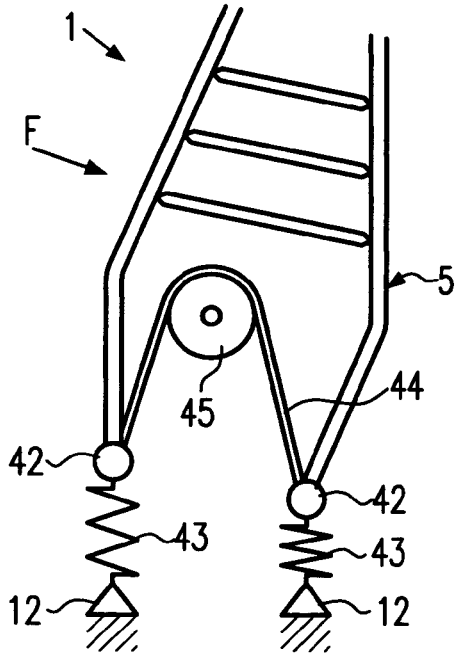
FIG. 14 shows the shape adjustment means of FIG. 13 in a second position.

FIGS. 13 and 14 show an embodiment where the proximal end of skeleton 5 is floatingly supported. FIG. 13 shows a neutral, substantially undeflected and undeformed position, FIG. 14 shows the skeleton 5 in a deflected or deformed state.

According to this embodiment, end points 42 of skeleton 5 at the proximal end are elastically attached to seating structure 12, which is depicted only schematically. The elastic support of end points 42 is represented by spring elements 43 interposed between skeleton 5 and seat support structure 12.

End points 42 are connected with each other via skeleton 5 and by means of a flexible connecting element 44. Connecting element 44 is deflected by a holding structure 45, which allows relative movement of the connection element 44 and holding structure 45 in response to a deformation or deflection of skeleton 5 under seating force F (cf. FIG. 14). Holding structure 45 is mounted on seat support structure 12 (not shown) and therefore supports the weight of skeleton 5 and guides seating force F into seat support structure 12.

The floating support comprising end points 42, connecting element 44 and holding structure 45 allows skeleton 5 an automatic, flexible adjustment to seating force F and to the contour of a human body 37 (cf. FIG. 11). Depending on the elasticity of spring elements 43 and connecting element 44, skeleton 5 becomes stiffer or softer.

In particular, as shown in FIG. 13, connecting element 44 may be a belt that is wound around a pulley as holding structure.

Figure 15:
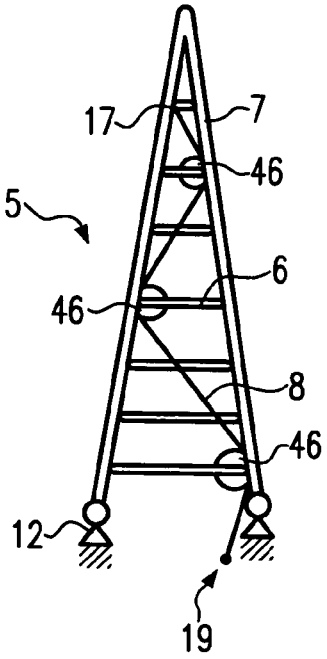
FIG. 15 shows a schematic representation of yet another embodiment of a shape adjustment means in a first position.
Figure 16:
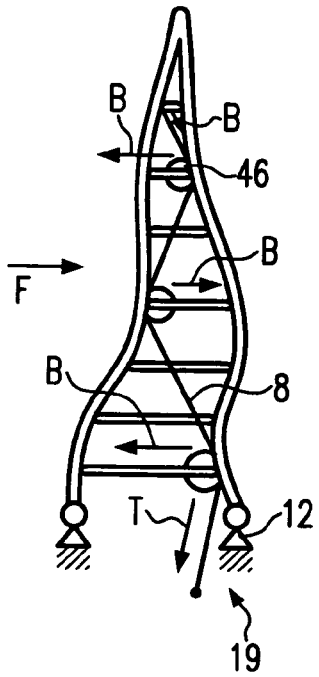
FIG. 16 shows the shape adjustment means of FIG. 15 in a second position.

FIGS. 15 and 16 schematically show the function of one embodiment of shape adjustment means 19 using tension element 8. Tension element 8 is of belt-like or rope-like configuration and guided over a series of pulleys 46 arranged in a zig-zag fashion on opposite ends of ribs 6 such that it runs substantially diagonal within a section defined by two ribs 6 and skin 7. Such a section constitutes the basic building block of skeleton 5. One end 47 of tension element is fixedly attached to skeleton 5.

FIG. 16 shows the reaction of skeleton 5 to a tension force T applied on tension element 8. At the pulleys 46, or, in general, at points, where tension element 8 is deflected, a force P is lead into skeleton 5. Tension force T strives to align pulleys 46 in the vertical direction, until tension element 8 runs in a straight line. Thus, skeleton 5 is deflected in a S-shaped manner. At the same time, skeleton 5 is loaded with a vertical bias force substantially from end 47 downwards, which stiffens skeleton 5.

Instead of a mechanical shape adjustment means 19, electrically powered adjustment means using electric motors may also be employed. Other means 19 may use pneumatic or fluidic elements to adjust the shape of skeleton 5. It has been found that the shape adjustment is most efficiently effected if shape adjustment means 19 is adapted to directly change the angle enclosed between ribs 6 and skin 7.

Figure 17:
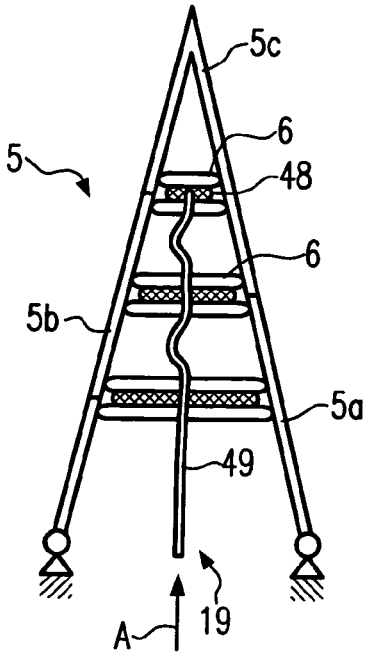
FIG. 17 shows a schematic representation of yet another embodiment of a shape adjustment means in a first position.
Figure 18:
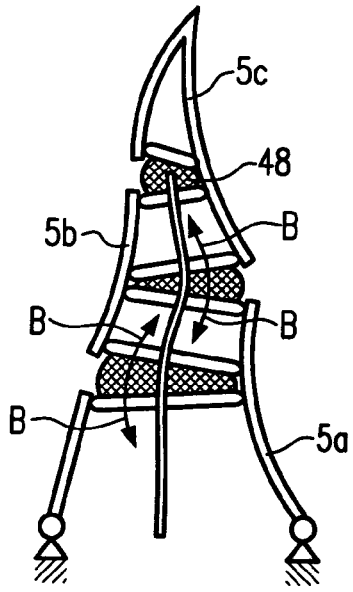
FIG. 18 shows the shape adjustment means of FIG. 17 in a second position.

One example of a pneumatic shape adjustment means 19 is schematically shown in FIGS. 17 and 18.

In this embodiment, skeleton 5 actually comprises three skeletons 5*a*, 5*b*, 5*c* as substructures, which are connected by means of elastic elements 48 on ribs 6. As shown in FIG. 17, substructures 5*a*, 5*b*, 5*c* may be interlocked in that substructure 5*c* is connected with both substructure 5*b* and substructure 5*a*.

The shape of skeleton 5 may be adjusted, as shown in FIG. 18 by inflating elements 48 with a fluid, e.g. air, supplied under pressure via a tube 49 from a pump mechanism, not shown. Alternatively, a gel may be supplied via tube 49.

By inflating balloon-like elements 48, substructures 5*a*, 5*b*, 5*c* assume new positions relative to each other. For example, an inclination of skeleton 5 may be effected, if elements 48, in the inflated state, are wedge-shaped and tapering towards one end of ribs 6.

Figure 19:
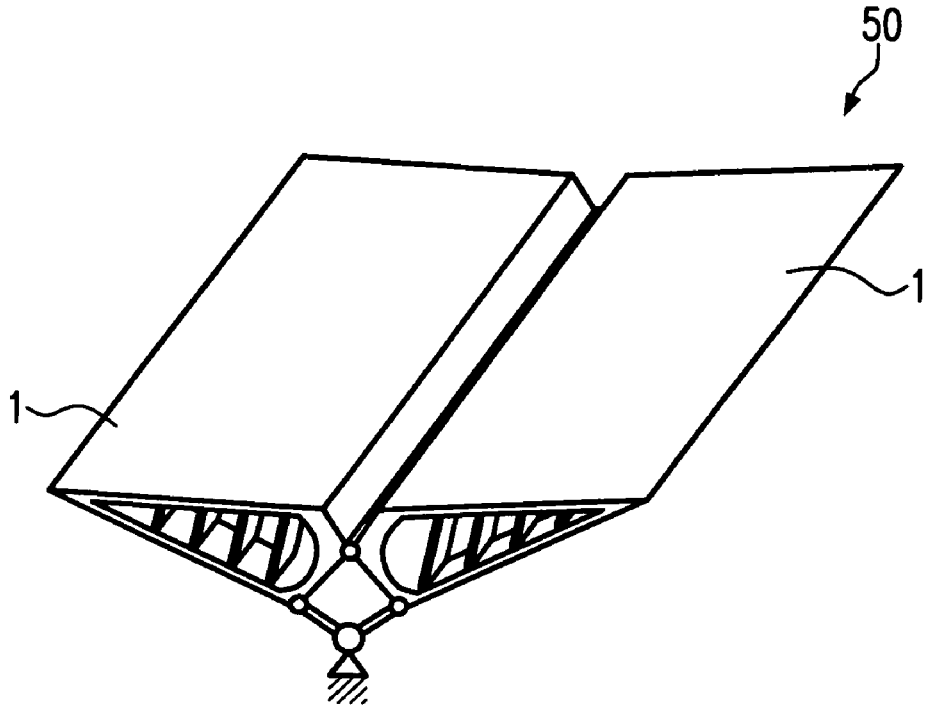
FIG. 19 shows a fourth and final embodiment of a seating element according to the invention, said seating element being used in a couch or bed and being in a first position.

FIG. 19 finally shows use of seating element 1 in a stretcher, bed or couch 50. The arrangement of seating elements 1 in bed 50 resemble closely the arrangement of seating elements 1 in the stool in FIG. 11.

Figure 20:
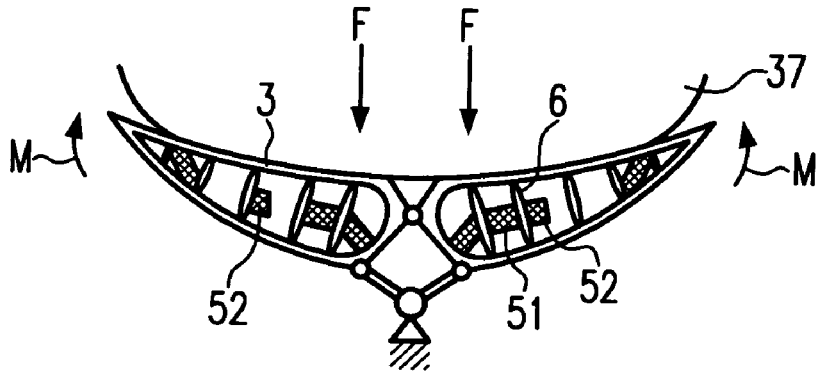
FIG. 20 shows the embodiment of FIG. 19 in a second position.

As can be seen in FIG. 20 use of skeleton 5 in bed 50 leads to an upward movement M of ends 11 if human body 30 exerts a seating force F on seating structure 1. Upwardly pointing ends 11 prevent body 30 from falling off bed 50. It should be noted, that the configuration of bed 50 with two laterally arranged skeletons 5 may also be used for the backs of chairs.

In FIG. 20, spacers 51 made from elastic material such as rubber, elastomeric materials or foam materials are arranged between ribs 6. Spacers 51 are deformed together with support area 3 and thus affect the overall elasticity of skeleton 5. Spacers 51 may have predetermined elastic properties, such as an elasticity increasing with the amount of deformation. Spacer 51 may be oriented parallel to skin 7 or along the diagonal of the section defined between two ribs and skin 7. Further, the spacers may be configured as stops 52, which come into contact with one of ribs 6 and/or skin 7 only after the skeleton 5 has been deformed to a pre-determined degree.

Finally, it should be noted that skeleton 5 may be used in any orientation and that a plurality of independently or dependently deformable skeletons 5 may be used to make up any kind of support area such as, for example, a backrest or a seat or a stretcher surface.

Spacers 51 may be biased in order to exert a biasing force on skeleton 5.

Obviously, many other modifications and variation of the present invention are possible in light of the above teachings. It is therefore to be understood that within the scope of the appended claims the inventions may be practiced otherwise than as specifically described.

What is claimed is:

1. A seating element comprising a skeleton having a skin and a plurality of ribs at respective ends pivotably connected with said skin, said skin forming a substantially flexible support area, which is adapted to support a seating force exerted by a body, said skeleton cooperating to at least partially deform said support area in a direction opposite to said seating force as a result of said seating force, wherein said skeleton further comprises at least one biasing element coupling together at least one of said ribs and said skin.

2. The seating element of claim 1, wherein a shape adjustment means is provided for the at least one biasing element, said shape adjustment means being adapted to introduce a biasing force into said skeleton, said skeleton adjusting its shape in response to said biasing force.

3. The seating element of claim 2, wherein said biasing force is transmitted into said skeleton via a tension element.

4. The seating element of claim 3, wherein said tension element is guided past and deflected by at least one of said ribs.

5. The seating element of claim 4, wherein said tension element is guided past said ribs in a zig-zag fashion within said skeleton.

6. The seating element according to claim 3, wherein said skeleton comprises at least one pulley attached to at least one of said skin and said ribs, said tension element being deflected by said pulley.

7. The seating element according to claim 6, wherein said pulley is connected to said skeleton in an area where one of said ribs is connected to said skin.

8. The seating element of claim 3, wherein one end of said tension element is attached to at least one of said skin and said ribs.

9. The seating element of claim 2, wherein said skeleton comprises a proximal end, at which two end points of said skin are situated, said shape adjustment means being adapted to generate said biasing force by shifting one of said two end points with respect to the other.

10. The seating element of claim 2, wherein said shape adjustment means comprises at least one actuator acting on at least one of said ribs, said actuator applying said biasing force on said at least one rib.

11. The seating element of claim 1, wherein said skeleton further comprises a substantially flexible spacer element, said spacer element being arranged between said ribs.

12. The seating element of claim 11, wherein said spacer element is configured as a fluid-filled pad.

13. The seating element of claimn 12, wherein said pad is filled with a gel material.

14. The seating element of claim 12, wherein said pad extends through said support area.

15. The seating element according to claim 1, wherein said skeleton comprises at least one hinge section, by which said skeleton is pivotably connected to a seating support structure.

16. The seating element according to claim 1, wherein said at least one tension element is connected with areas, in which said ribs are attached to said skin.

17. The seating element according to claim 1, wherein said skin and said ribs are integrally formed as a unitary piece.

18. A seating element comprising a skeleton having a skin and a plurality of ribs at respective ends pivotably connected with said skin, said skin forming a substantially flexible support area, which is adapted to support a seating force exerted by a body, said skeleton cooperating to at least partially deform said support area in a direction opposite to said seating force as a result of said seating force, wherein said skin integrally forms a backrest and a seat.

19. The seating element of claim 18, wherein said skin and said ribs are formed integrally as a unitary piece.

20. The seating element of claim 18, wherein a shape adjustment means is provided, said shape adjustment means being adapted to introduce a biasing force into said skeleton, said skeleton adjusting its shape in response to said biasing force.

21. A seating element comprising a skeleton having a skin and a plurality of ribs at respective ends pivotably connected with said skin, said skin forming a substantially flexible support area, which is adapted to support a seating force exerted by a body, said skeleton cooperating to at least partially deform said support area in a direction opposite to said seating force as a result of said seating force, wherein said seating element further comprises a shape adjustment means, said shape adjustment means being adapted to introduce a biasing force into said skeleton, said skeleton adjusting its shape in response to said biasing force.

22. The seating element of claim 21, wherein said shape adjustment means is adapted to introduce said biasing force substantially along a diagonal of a section made up of two of said ribs and said skin.

23. The seating element of claim 22, wherein said shape adjustment means comprises a tension element, said tension element transmitting said biasing force as a tensile force.

24. The seating element of claim 22, wherein said shape adjustment means comprises a pressure element, said pressure element transmitting said biasing force as a tensile force.

25. A seating element comprising a skeleton having a skin and a plurality of ribs pivotably connected with said skin, said skin forming a substantially flexible support area, which is adapted to support a seating force exerted by a body, said skeleton cooperating to at least partially deform said support area in a direction opposite to said seating force as a result of said seating force, wherein a biasing element is provided, which is oriented substantially along a diagonal of a section of said skeleton, said section being defined by two of said ribs and said skin.

26. The seating element of claim 25, wherein said biasing element is configured as a tension element.

27. The seating element of claim 25, wherein said biasing element is configured as a pressure element.

* * * * *